US008333462B2

(12) United States Patent
Nishimura

(10) Patent No.: US 8,333,462 B2
(45) Date of Patent: Dec. 18, 2012

(54) INK JET PRINTER HAVING INK MAINTENANCE SYSTEM

(75) Inventor: Asayo Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/240,440

(22) Filed: Sep. 22, 2011

(65) Prior Publication Data

US 2012/0013659 A1 Jan. 19, 2012

Related U.S. Application Data

(62) Division of application No. 12/453,722, filed on May 20, 2009, now Pat. No. 8,042,896.

(30) Foreign Application Priority Data

May 21, 2008 (JP) ..... P2008-133427

(51) Int. Cl.
*B41J 2/18* (2006.01)
*B41J 29/38* (2006.01)

(52) U.S. Cl. ..... 347/89; 347/11

(58) Field of Classification Search ..... 347/89
See application file for complete search history.

(56) References Cited

U.S. PATENT DOCUMENTS 6,386,664 B1 * 5/2002 Hosono et al. ..... 347/9
6,431,674 B2 * 8/2002 Suzuki et al. ..... 347/10
7,140,724 B2 11/2006 Otis et al.
7,416,288 B2 8/2008 Takatsuka
7,770,990 B2 8/2010 Nagashima
2004/0085416 A1 * 5/2004 Kent ..... 347/89

FOREIGN PATENT DOCUMENTS

JP 11-342634 A 12/1999
JP 2001-270134 A 10/2001
JP 2002001951 A * 1/2002
JP 2004-148826 A 5/2004
JP 2005-41050 A 2/2005
JP 2006-088575 A 4/2006

OTHER PUBLICATIONS

Machine generated English translation of JP 2002-001951A "Ink Jet Recording Apparatus" to Cho; generated via http://www19.ipdl.inpit.go.jp/PA1/cgi-bin/PA1INDEX on Sep. 4, 2012; 21 pp.*

* cited by examiner

*Primary Examiner* — Shelby Fidler
(74) *Attorney, Agent, or Firm* — Nath, Goldberg & Meyer; Jerald L. Meyer; Stanley N. Protigal

(57) ABSTRACT

An ink jet printer performs a print process by ejecting ink for each of a plurality of ink colors. When a predetermined first circulation time elapses after starting the ink circulation, an ink agitating operation drive signal generation unit applies an ink agitating operation drive signal to an ink ejecting unit set operable to eject an ink, which has a predetermined nature, for a first ink agitating operation time in a first period, and applies the ink agitating operation drive signal to an ink ejecting unit set operable to eject an ink, which has not the predetermined nature, for a second ink agitating operation time in a second period which is shorter than the first period. It is therefore possible to perform maintenance effectively in advance of starting the print process in accordance with the nature of ink.

2 Claims, 8 Drawing Sheets

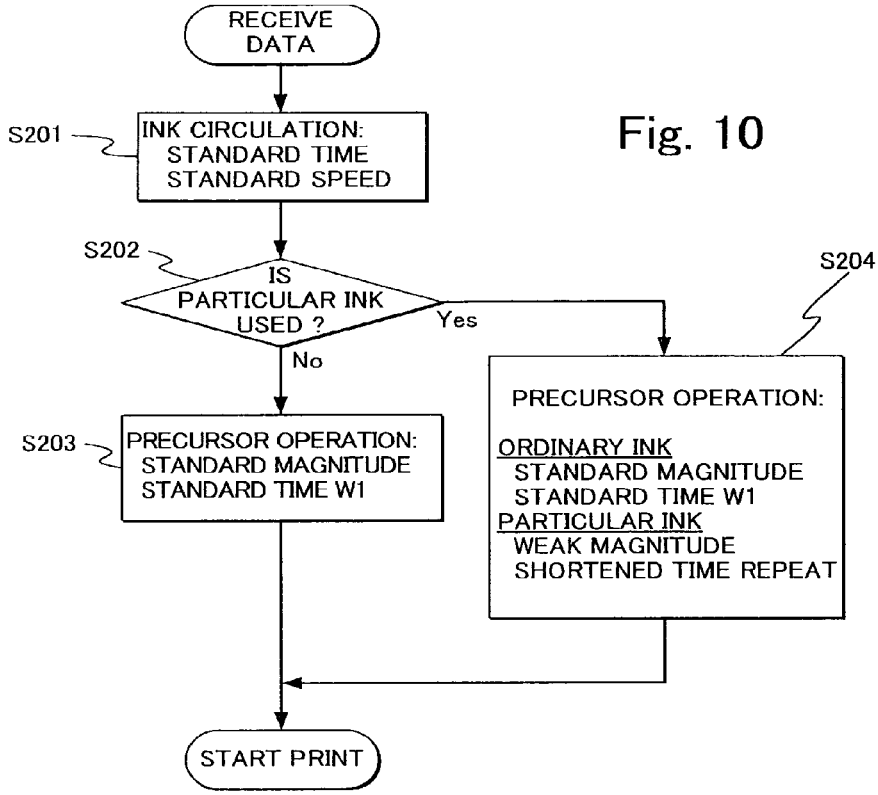
Fig. 10
Fig. 11
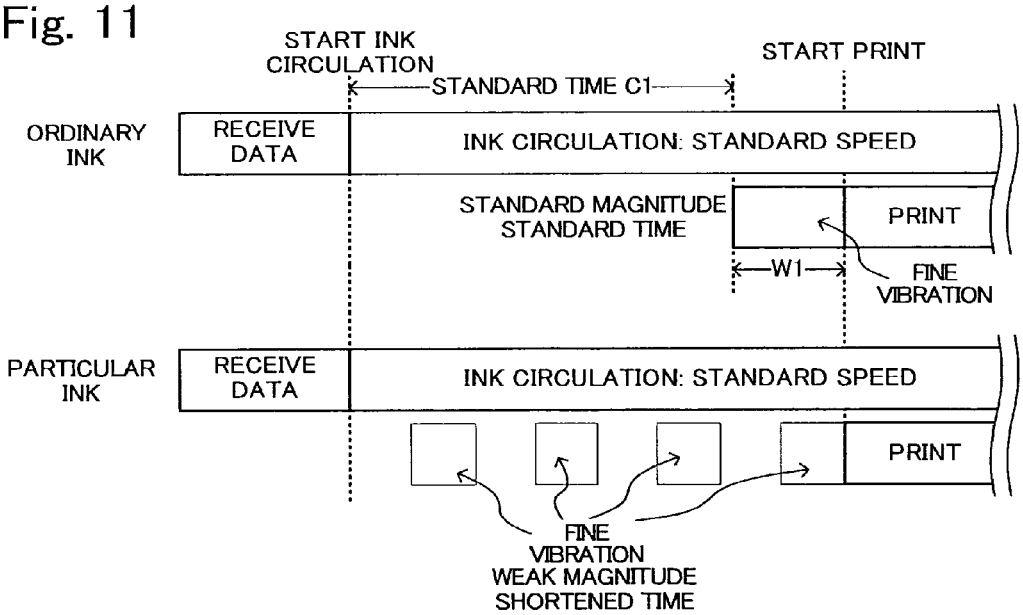

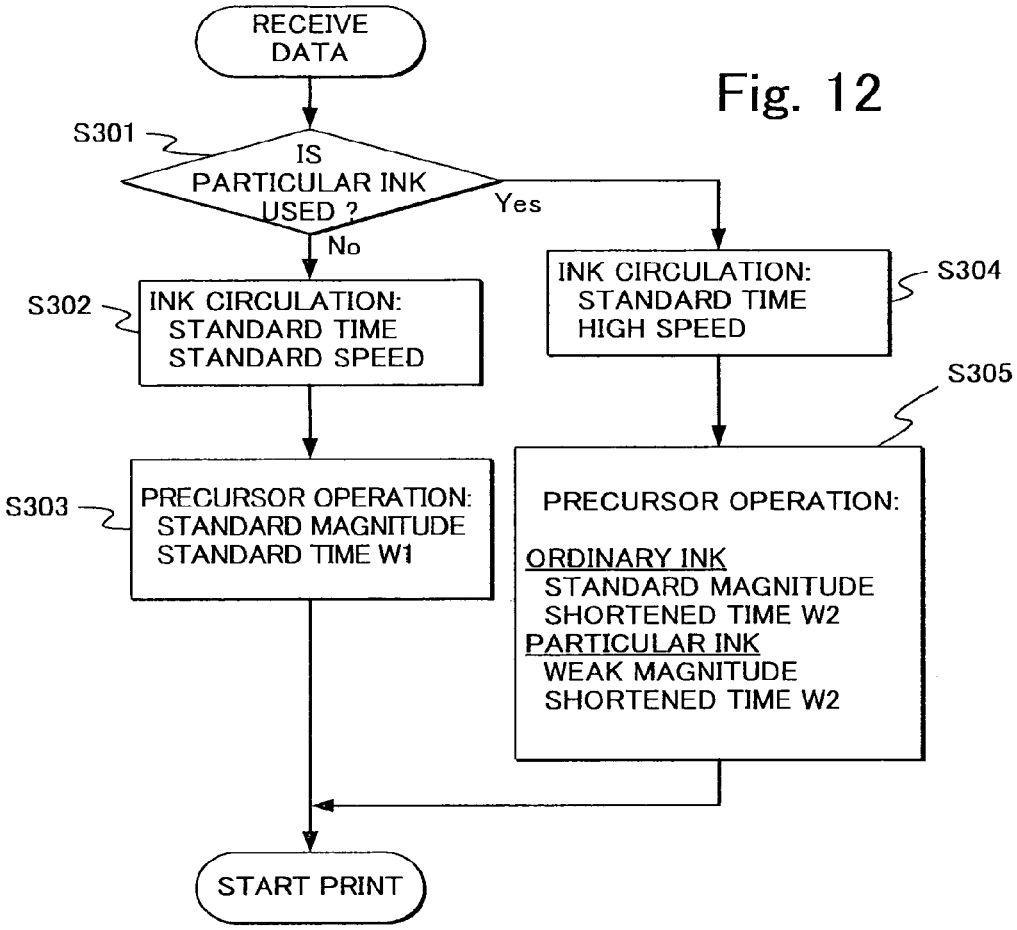
Fig. 12
Fig. 13
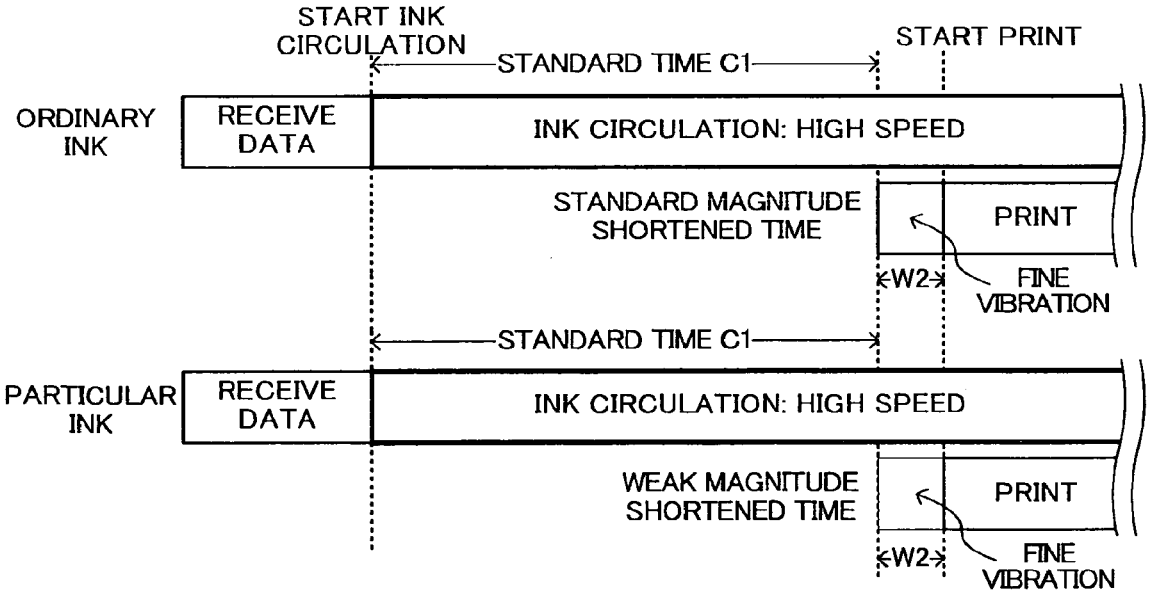

INK JET PRINTER HAVING INK MAINTENANCE SYSTEM

This is a Divisional Application filed under 35 U.S.C. §120 as a division of U.S. patent application Ser. No. 12/453,722, filed on May 20, 2009, an application claiming the benefit under 35 U.S.C. §119 of Japanese Application No. P2008-133427,filed on May 21, 2008, the content of each of which is hereby incorporated by reference in its entirety.

BACKGROUND OF THE INVENTION

1. Field of the Invention

The present invention relates to a maintenance technique to be performed in advance of starting print process for ink jet printers having an ink circulation mechanism.

2. Description of the Background Art

In the case of an ink jet printer which prints images by ejecting ink from nozzles, when the print process has not been performed over a long time, the solvent of ink is evaporated or volatilized in the vicinity of ink jet heads so that the viscosity of ink is increased. If the viscosity of ink is increased, the print functionality cannot be fully performed. Because of this, as the need arises, a maintenance operation is performed, for example, by suctioning the ink, cleaning nozzles and so forth. However, there is a problem that a certain amount of ink is consumed by the maintenance operation of suctioning the ink, cleaning nozzles and so forth.

In this situation, conventionally, the thickened ink is recovered by applying fine vibration to the ink chamber of an ink jet head for agitating the ink to the extent that ink is not ejected from the nozzles, as the maintenance procedure in advance of the print process, as described in Japanese Patent Published Application No. 2005-41050. Such an operation of generating fine vibration is generally called a precursor operation.

Furthermore, in recent years, it is proposed to provide an ink circulation route in the body of an ink jet printer to enable ink circulation for the purpose of improving the reliability of the print process as described in Japanese Patent Published Application No. Hei 11-342634. In the case of the ink jet printer having such an ink circulation mechanism, even if a nozzle clogs up with bubbles or debris, quick recovery is possible, and the ink circulation through the ink chamber of an ink jet head serves to sweep away high viscosity ink to the ink circulation route.

When performing the precursor operation, the strength and the driving time can be determined. Appropriate strength and driving time for recovering the high viscosity ink effectively by the precursor operation are determined in accordance with experiments and so on. On the other hand, since there are a number of inks which differs in composition and characteristics, when the precursor operation which is effectively for recovering the high viscosity is performed, the printing quality may be adversely affected by the precursor operation depending upon the characteristics of ink. For example, in the case where an ink tends to generate bubbles when fine vibration is applied to the ink by the precursor operation, the ink may be ejected in an uneven manner because of the bubbles generated by the precursor operation.

Because of this, for the ink which is vulnerable to the precursor operation, it can be considered that a weaker precursor operation is performed for a shorter period than for other inks. However, while the harmful effect of the precursor operation on the printing quality can be avoided by this solution, the high viscosity ink may not sufficiently be recovered by the precursor operation.

SUMMARY OF THE INVENTION

Taking into consideration the above circumstances, it is an object of the present invention to provide an ink jet printer which makes it possible to perform maintenance of thickened ink in advance of starting print process in accordance with the nature of ink.

In order to accomplish the object as described above, an ink jet printer of the first aspect of the present invention performs a print process by ejecting ink for each of a plurality of ink colors, and comprises: a plurality of ink jet heads provided for the plurality of ink colors respectively, each ink jet head being provided with an ink ejection unit set; a plurality of ink circulation routes provided for the plurality of ink colors respectively, each ink circulation route including the ink jet head corresponding thereto; an ink agitating operation drive signal generation unit operable to generate an ink agitating operation drive signal to be applied to the ink ejecting unit sets of the ink jet heads, to the extent that ink is not ejected, in advance of starting the print process; and an ink circulation control unit operable to control ink circulation in the ink circulation routes, wherein the ink circulation control unit starts ink circulation in advance of starting the print process, and wherein, when a predetermined first circulation time elapses after starting the ink circulation, the ink agitating operation drive signal generation unit applies the ink agitating operation drive signal to the ink ejecting unit set operable to eject an ink, which has a predetermined nature, for a predetermined first ink agitating operation time in a predetermined first period, and applies the ink agitating operation drive signal to the ink ejecting unit set operable to eject an ink, which has not the predetermined nature, for a predetermined second ink agitating operation time in a predetermined second period which is shorter than the first period.

For example, the device for ejecting ink may be a piezoelectric element. In this case, the ink ejecting unit set may be implemented with a set of piezoelectric elements and a set of drive transistors serving to drive the set of piezoelectric elements. Also, the ink agitating operation drive signal generation unit may be formed, for example, by a precursor control unit and a drive signal generation circuit of the following embodiment to be described below. The ink circulation control unit is for example an ink circulation control unit of the following embodiment.

In order to avoid ink ejection failure due to the ink agitating operation, while the ink circulation is performed, the ink agitating operation drive signal is applied to the ink ejecting unit set operable to eject an ink, which has a predetermined nature, for a shorter time and in a longer period than is applied to the other ink ejecting unit set.

The first circulation time corresponds to the elongated time C2 of the following embodiment to be described below. The first period corresponds to the weak magnitude mode of the following embodiment. The first ink agitating operation time corresponds to the shortened time (W2) of the following embodiment. Also, the second period corresponds to the standard magnitude mode of the following embodiment. The second ink agitating operation time corresponds to the shorter time of the following embodiment.

In a preferred embodiment, in the case where the ink jet printer does not use the ink ejecting unit set operable to eject the ink which has the predetermined nature, when a second circulation time which is shorter than the first circulation time elapses after starting the ink circulation, the ink agitating operation drive signal generation unit applies the ink agitating operation drive signal to the ink ejecting unit set in the second period for a third ink agitating operation time which is longer than the second ink agitating operation time.

On the other hand, in the case where the ink jet printer uses the ink ejecting unit set operable to eject the ink which has the predetermined nature, the ink circulation time is elongated to enhance the effects of recovering the thickened ink. However, if the ink circulation time is elongated, the other inks are excessively agitated so that the ink agitating operation times for the other inks are shortened. In this case, the second circulation time corresponds to the standard time of the following embodiment to be described below, and the third ink agitating operation time corresponds to the standard time of the following embodiment.

In order to accomplish the object as described above, an ink jet printer of the second aspect of the present invention performs a print process by ejecting ink for each of a plurality of ink colors, and comprises: a plurality of ink jet heads provided for the plurality of ink colors respectively, each ink jet head being provided with an ink ejection unit set; a plurality of ink circulation routes provided for the plurality of ink colors respectively, each ink circulation route including the ink jet head corresponding thereto; an ink agitating operation drive signal generation unit operable to generate an ink agitating operation drive signal to be applied to the ink ejecting unit sets of the ink jet heads, to the extent that ink is not ejected, in advance of starting the print process; and an ink circulation control unit operable to control ink circulation in the ink circulation routes, wherein the ink circulation control unit starts ink circulation in advance of starting the print process, and wherein, after starting the ink circulation, the ink agitating operation drive signal generation unit applies the ink agitating operation drive signal to the ink ejecting unit set operable to eject an ink, which has a predetermined nature, for a predetermined first ink agitating operation time in a predetermined first period, and repeating this application of the ink agitating operation drive signal with a break period before each repetition, wherein, when a predetermined second circulation time elapses after starting the ink circulation, the ink agitating operation drive signal generation unit applies the ink agitating operation drive signal to the ink ejecting unit set operable to eject an ink, which has not a predetermined nature, for a predetermined third ink agitating operation time which is longer than the first ink agitating operation time in a predetermined second period which is shorter than the first period.

Also in the case of the second aspect, for example, the device for ejecting ink may be a piezoelectric element. In this case, the ink ejecting unit set may be implemented with a set of piezoelectric elements and a set of drive transistors serving to drive the set of piezoelectric elements. Also, the ink agitating operation drive signal generation unit may be formed, for example, by a precursor control unit and a drive signal generation circuit of the following embodiment to be described below. The ink circulation control unit is for example an ink circulation control unit of the following embodiment.

In order to avoid ink ejection failure due to the ink agitating operation, while the ink circulation is performed, the ink agitating operation drive signal is applied to the ink ejecting unit set operable to eject an ink, which has a predetermined nature, for a shorter time and in a longer period than is applied to the other ink ejecting unit set. This application is performed for a plurality of times, so as to enhance the effects for recovering thickened ink.

In order to accomplish the object as described above, an ink jet printer of the third aspect of the present invention performs a print process by ejecting ink for each of a plurality of ink colors, and comprises: a plurality of ink jet heads provided for the plurality of ink colors respectively, each ink jet head being provided with an ink ejection unit set; a plurality of ink circulation routes provided for the plurality of ink colors respectively, each ink circulation route including the ink jet head corresponding thereto; an ink agitating operation drive signal generation unit operable to generate an ink agitating operation drive signal to be applied to the ink ejecting unit sets of the ink jet heads, to the extent that ink is not ejected, in advance of starting the print process; and an ink circulation control unit operable to control ink circulation in the ink circulation routes, wherein the ink circulation control unit starts ink circulation at a predetermined first ink speed in advance of starting the print process, and wherein, when a predetermined second circulation time elapses after starting the ink circulation, the ink agitating operation drive signal generation unit applies the ink agitating operation drive signal to the ink ejecting unit set operable to eject an ink, which has a predetermined nature, for a predetermined first ink agitating operation time in a predetermined first period, and applies the ink agitating operation drive signal to the ink ejecting unit set operable to eject an ink, which has not the predetermined nature, for a predetermined second ink agitating operation time in a predetermined second period which is shorter than the first period.

Also in the case of the third aspect, for example, the device for ejecting ink may be a piezoelectric element. In this case, the ink ejecting unit set may be implemented with a set of piezoelectric elements and a set of drive transistors serving to drive the set of piezoelectric elements. Also, the ink agitating operation drive signal generation unit may be formed, for example, by a precursor control unit and a drive signal generation circuit of the following embodiment to be described below. The ink circulation control unit is for example an ink circulation control unit of the following embodiment.

In order to avoid ink ejection failure due to the ink agitating operation, while the ink circulation is performed, the ink agitating operation drive signal is applied to the ink ejecting unit set operable to eject an ink, which has a predetermined nature, for a shorter time and in a longer period than is applied to the other ink ejecting unit set. In this case, the first ink speed corresponds to the higher speed of the following embodiment.

Incidentally, in the case where the ink jet printer does not use the ink ejecting unit set operable to eject the ink which has the predetermined nature, the ink circulation control unit starts ink circulation at a second ink speed which is lower than the first ink speed in advance of starting the print process, and when a second circulation time elapses after starting the ink circulation, the ink agitating operation drive signal generation unit applies the ink agitating operation drive signal to the ink ejecting unit set in the second period for a third ink agitating operation time which is longer than the second ink agitating operation time.

Namely, if the ink which has the predetermined nature is used, the ink circulation speed is increased to enhance the effects for recovering thickened ink. However, if the ink circulation speed becomes high, the other inks are excessively agitated so that the ink agitating operation times for the other inks are shortened. In this case, the second ink speed corresponds to the standard speed of the following embodiment to be described below.

In each of the above case, the ink jet printer may be provided with an ink temperature thermometer operable to measure the ink temperature, wherein when the ink temperature measured by the ink temperature thermometer exceeds a predetermined temperature, the ink agitating operation drive signal generation unit elongates the time for which the ink agitating operation drive signal is applied to the ink ejecting unit set operable to eject an ink, which has not the predetermined nature.

Since the viscosity of ink generally increases as the temperature rises, the ink agitation time is made longer by elongating the time for which the ink agitating operation drive signal is applied. However, shortcomings may occur when the ink agitation time is made longer for the ink which has the predetermined nature, so that the application time is not elongated.

More specifically speaking, the ink which has the predetermined nature is an ink with which ejection failure occurs when the ink agitating operation drive signal is continuously applied to the ink ejecting unit set in the second period.

The ink ejecting unit set may use the vibration of a piezoelectric element to eject ink. In this case, the ink agitating operation is performed by the piezoelectric element as fine vibration application. Alternatively, the ink ejecting unit set may eject ink by generating bubbles. In this case, the ink agitating operation is performed by generating bubbles.

In accordance with the present invention, an ink jet printer is provided which makes it possible to perform maintenance of thickened ink in advance of starting print process in accordance with the nature of ink.

BRIEF DESCRIPTION OF THE DRAWINGS

FIG. 10 is a flow chart for explaining the ink agitation process in accordance with a second example of the embodiment of the present invention.

FIG. 11 is a schematic diagram for showing the process in a time series when the particular ink is used in accordance with the second example.

FIG. 12 is a flow chart for explaining the ink agitation process in accordance with a third example of the embodiment of the present invention.

FIG. 13 is a schematic diagram for showing the process in a time series when the particular ink is used in accordance with the third example.

DESCRIPTION OF THE PREFERRED EMBODIMENTS

Figure 1:
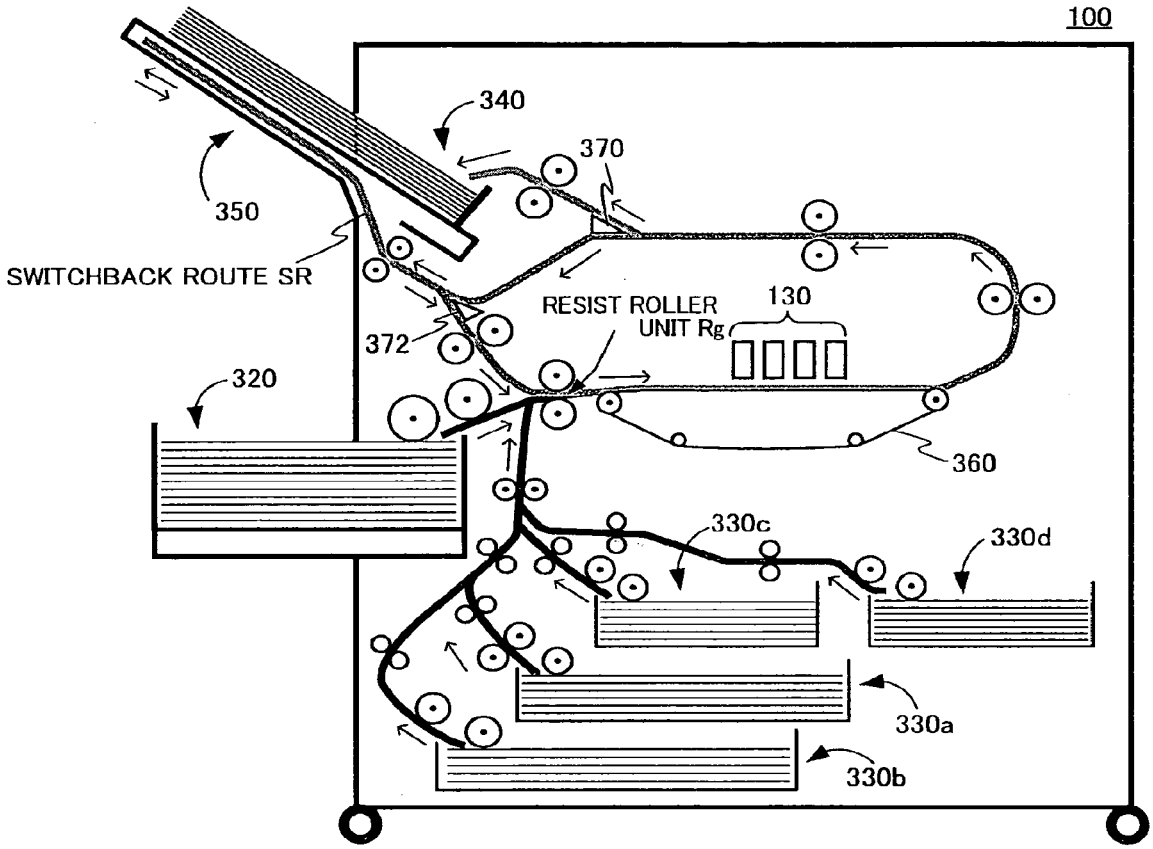
FIG. 1 is a schematic diagram for showing an ink jet printer in accordance with an embodiment of the present invention.

In the following description, an embodiment of the present invention will be explained in conjunction with the accompanying drawings. FIG. 1 is a schematic diagram for showing an ink jet printer 100 in accordance with the present invention. Particularly, this figure shows print sheet circulation transportation routes. As shown in the same figure, the ink jet printer 100 is provided with a paper feed mechanism for feeding print sheets including a paper feed side tray 320 exposed from the side surface of the housing of the ink jet printer 100, a plurality of paper feed trays 330*a*, 330*b*, 330*c* and 330*d* which are located inside the housing. Furthermore, a discharge port 340 is provided as a discharge mechanism for discharging print sheets which have been printed.

The ink jet printer 100 is a line color ink jet printer. The line color ink jet printer is provided as a print mechanism with a plurality of ink jet heads each of which is provided with a number of nozzles formed to span the route in the direction perpendicular to the paper transportation direction. The respective ink jet heads eject black and color inks respectively in order to print images of the respective colors on a line-by-line basis. However, the present invention is not limited to the line ink jet printer 100, but also applicable to other types of printing apparatuses such as a serial color printer capable of forming images by scanning in the line direction.

The print sheets fed from either the paper feed side tray 320 or one of the paper feed trays 330 are transported one after another along a paper feed transportation route (indicated with bold line in the figure) by a transportation mechanism such as roller units to a resist roller unit Rg. The resist roller unit Rg is composed of a pair of rollers and provided for defining a reference position at which the leading edge of each print sheet is aligned and oriented. The print sheet which is fed is stopped at the resist roller unit Rg for a short time, and then transferred in the direction toward the print mechanism with a predetermined timing.

A plurality of ink heads 130 are located on the transfer direction side of the resist roller unit Rg. The print sheet is printed to form an image with ink ejected from the respective ink jet heads 130 on a line-by-line basis, while being transported at a predetermined speed in accordance with printer option settings on a conveyor endless belt 360 which is located on the opposite side to the ink jet heads 130.

The print sheet which has been printed is further transported in the housing by the transportation mechanism such as roller units. In the case of one-side printing for printing only one side of the print sheet, the print sheet is transferred directly to the discharge port 340 and stacked on a catch tray 350 provided as a receiver at the discharge port 340 with the printed side down. The catch tray 350 is provided to protrude from the housing with a certain thickness. The catch tray 350 is slanted with a lower upright wall at which print sheets discharged from the discharge port 340 are automatically aligned under their own weight.

In the case of double-side printing for printing both sides of the print sheet, the print sheet is not transferred to the discharge port 340 just after printing the main side (the first printed side is called "main side", and the next printed side is called "back side" in this description), but is transported again in the housing. Because of this, the ink jet printer 100 is provided with a shunt mechanism 370 for switching the transfer route for printing on the back side. After printing on the main side, the shunt mechanism 370 transfers the print sheet which is not discharged to a switchback route SR such that the print sheet is reversed with respect to the transportation route by the switchback operation. The print sheet is transferred to the resist roller unit Rg again through a switching mechanism 372 by the transportation mechanism such as roller units, and stopped at this resist roller unit Rg for a short time. Thereafter, the print sheet is transported to the print mechanism with a predetermined timing, and printed on the backside in the same manner as on the main side. After printing on the back side, the print sheet with images printed on the both sides is transferred to the discharge port 340, and stacked on the catch tray 350 serving as the receiver at the discharge port 340.

In the ink jet printer 100, the switchback operation is performed in the double-side printing mode by the use of the space formed in the lower portion of the catch tray 350. The space formed in the catch tray 350 is designed such that the print sheet cannot be accessed externally during the switchback operation. By this configuration, it is avoided that a user extracts the print sheet during the switchback operation by mistake. Incidentally, since the catch tray 350 is indispensable for the ink jet printer 100, there is no need for a separate space, which would be particularly provided in the ink jet printer 100 for the switchback operation, while making use of the space in the catch tray 350 for the switchback operation. Accordingly, it is possible to prevent the size of the housing from increasing for the purpose of implementing the switchback operation. Furthermore, since the discharge port and the switchback route are separated, the paper discharge operation can be performed in parallel with the switchback operation.

Figure 2:
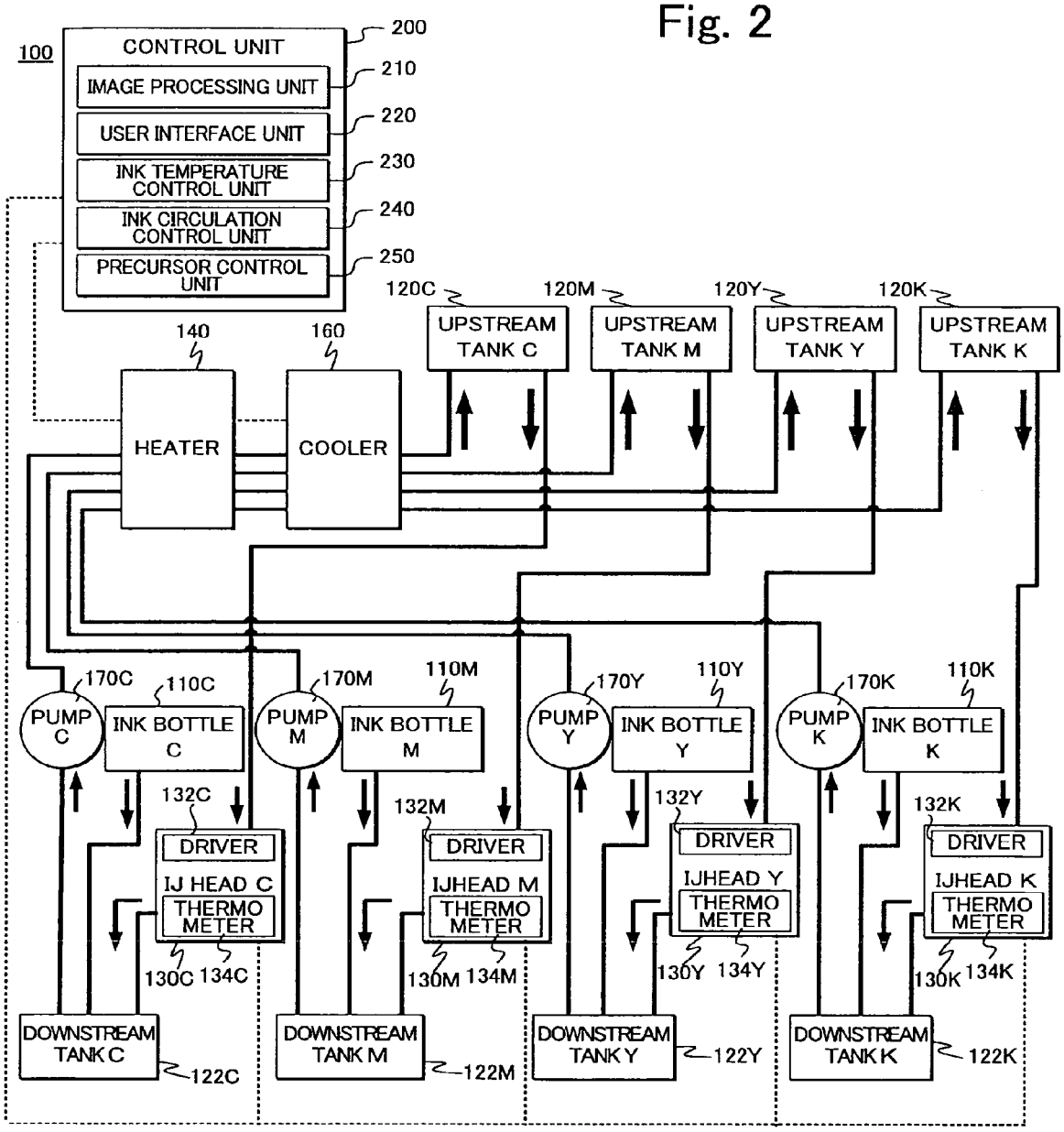
FIG. 2 is a block diagram for showing the configuration of ink routes of the ink jet printer in accordance with the embodiment of the present invention.

FIG. 2 is a block diagram for showing the configuration of the ink routes of the ink jet printer 100. As shown in the same figure, the ink jet printer 100 is a color printer capable of printing by the use of four color inks C, M, Y and K. The inks of the respective colors are supplied from detachable ink bottles, i.e., an ink bottle 110C for supplying cyan ink, an ink bottle 110M for supplying magenta ink, an ink bottle 110Y for supplying yellow ink, and an ink bottle 110K for supplying black ink. Each of these ink bottles is generally referred to simply as the ink bottle 110.

Also, the ink jet printer 100 is provided with a control unit 200. The control unit 200 is a functional unit of the ink jet printer 100 serving to control the print process, ink temperature, ink circulation, precursor operation and so forth. The hardware of the control unit 200 includes a CPU, an image processing apparatus, a memory and the like.

The control unit 200 of the present embodiment is provided with an image processing unit 210 which calculates the ink amount to be discharged for each dot (pixel) of an image on the basis of the print data, a user interface unit 220 which enable the user to receive and input information through an operation panel and so forth, an ink temperature control unit 230 which manages and controls the ink temperature, an ink circulation control unit 240 which controls ink circulation, and a precursor control unit 250 which controls the precursor operation.

The precursor control unit 250 serves, in cooperation with a drive signal generation circuit 132*a* to be described below, as a fine vibration drive signal generation unit which generates an ink agitating operation drive signal to be applied to the ink ejection unit set of the ink jet head in advance of starting actual printing operation, to the extent that ink is not ejected. The ink circulation control unit 240 serves as an ink circulation control unit which controls the circulation of ink around an ink circulation route.

The ink which is supplied from each of the detachable ink bottles 110 is passed through a flow conduit formed by a resin or metallic pipe, and stored temporarily in a downstream tank which is located on the downstream side of the ink jet heads 130. Namely, the ink jet printer 100 is provided with a downstream tank 122C for storing the cyan ink, a downstream tank 122M for storing the magenta ink, a downstream tank 122Y for storing the yellow ink, and a downstream tank 122K for storing the black ink. Each of these downstream tanks is generally referred to simply as the downstream tank 122.

The ink stored in the downstream tank 122 is transferred to an upstream tank which is provided on the upstream side of the ink jet head 130 by a pump 170. Namely, the ink jet printer 100 is provided with a pump 170C for moving the cyan ink, a pump 170M for moving the magenta ink, a pump 170Y for moving the yellow ink, and a pump 170K for moving the black ink. Each of these pumps is generally referred to simply as the pump 170. Also, the ink jet printer 100 is provided with an upstream tank 120C for storing the cyan ink, an upstream tank 120M for storing the magenta ink, an upstream tank 120Y for storing the yellow ink, and an upstream tank 120K for storing the black ink. Each of these upstream tanks is generally referred to simply as the upstream tank 120.

The ink stored in the upstream tank 120 is transferred to the ink jet head provided with a number of nozzles which eject droplets of ink for printing. As shown in this figure, the ink jet heads of the ink jet printer 100 include an ink jet head 130C for ejecting the cyan ink, an ink jet head 130M for ejecting the magenta ink, an ink jet head 130Y for ejecting the yellow ink, and an ink jet head 130K for ejecting the black ink. Each of these ink jet heads is generally referred to simply as the ink jet head 130.

In the case of the present embodiment, it is assumed that the ink jet head 130 ejects droplets of ink by the use of piezoelectric elements. Namely, the piezoelectric elements function as elements for ejecting ink. Alternatively, the ink jet head provided with the piezoelectric elements may be replaced by the ink jet head which can eject ink by thermally generating bubbles with a heating element to heat ink. When this alternative is implemented, the fine vibration generation by the piezoelectric elements as explained in the following description is considered to be replaced with the fine bubble generation by the heating element.

The ink jet head 130 is provided with a driver 132 (132C, 132M, 132Y or 132K) for driving the piezoelectric elements on the basis of image data transmitted from the control unit 200. Incidentally, the ink jet printer 100 employs an ink circulation system such that the ink remaining in the ink jet head 130 after the print process is returned to the downstream tank 122 through an ink circulation route. The water head difference between the upstream tank 120 and the downstream tank 122 is used to return the ink to the downstream tank 122 from the upstream tank 120 through the ink jet heads 130. Even if a nozzle clogs up with bubbles or debris and cannot eject ink, quick recovery is possible by circulating ink such that the ink circulation through the ink chamber of an ink jet head 130 sweeps away high viscosity ink to the ink circulation route.

A warranty temperature range is defined to ensure print quality. When the ink temperature drops below this warranty temperature range, the ink has to be heated. Because of this, there is a heater 140 on the ink flow routes. The ink temperature control unit 230 serves to control the operation of the heater 140. On the other hand, the driver 132 and the piezoelectric elements generate heat during operation. A cooler 160 is provided for cooling the ink in order to prevent the print process from being affected by the increased temperature due to the generated heat or heat associated with ink vibration in high temperature. The ink is passed through the heater 140 and the cooler 160 for controlling the temperature, and then transferred to the upstream tank 120.

Also, the ink jet head 130 is provided with a thermometer 134 (134C, 134M, 134Y, 134K) for directly or indirectly measuring the ink temperature.

Figure 3:
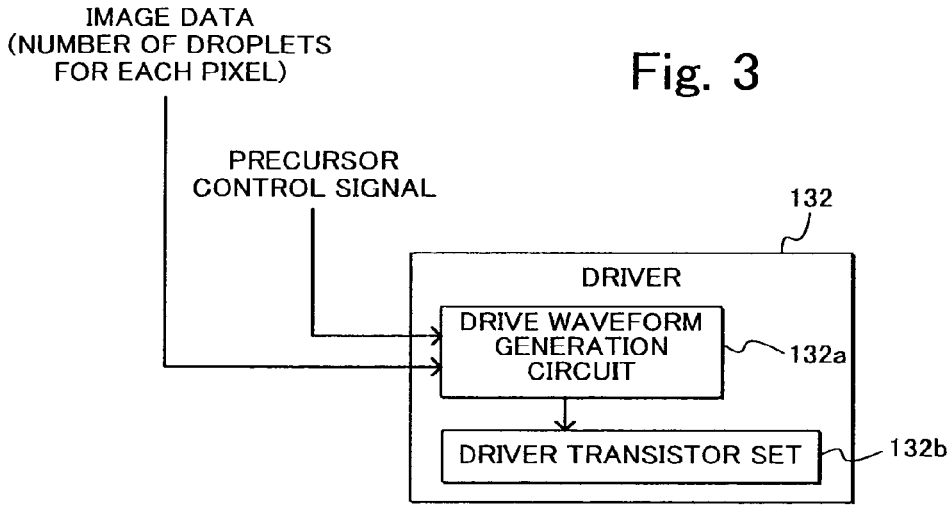
FIG. 3 is a block diagram showing the configuration of the driver of the ink jet head provided in the ink jet printer in accordance with the embodiment of the present invention.

FIG. 3 is a block diagram showing the configuration of the driver 132 of the ink jet head 130. As shown in the same figure, the driver 132 is provided with a drive waveform generation circuit 132*a* and a driver transistor set 132*b*. The drive waveform generation circuit 132*a* serves to generate drive signals having waveforms for driving the piezoelectric elements on the basis of the image data output from the image processing unit 210, and outputs drive signals to the driver transistor set 132*b* in accordance with the waveforms. The driver transistor set 132*b* includes a set of driver transistors which apply voltages to the piezoelectric elements on the basis of the drive waveforms output from the drive waveform generation circuit 132*a*. In other words, the driver transistor set 132*b* serves as the ink ejection unit set of the ink jet head 130 in cooperation with the piezoelectric elements.

In addition to this, the drive waveform generation circuit 132*a* generates a waveform on the basis of a precursor control signal output from the precursor control unit 250 for driving the piezoelectric elements to the extent that ink is not ejected, and outputs a drive signal having this waveform to the driver transistor set 132*b*. Namely, the drive waveform generation circuit 132*a* serves, in cooperation with the precursor control unit 250, as an ink agitating operation drive signal generation unit which generates an ink agitating operation drive signal to be applied to the ink ejection unit set of the ink jet head, to make ink agitating operation to the extent that ink is not ejected, in advance of starting actual printing operation.

Figure 4:
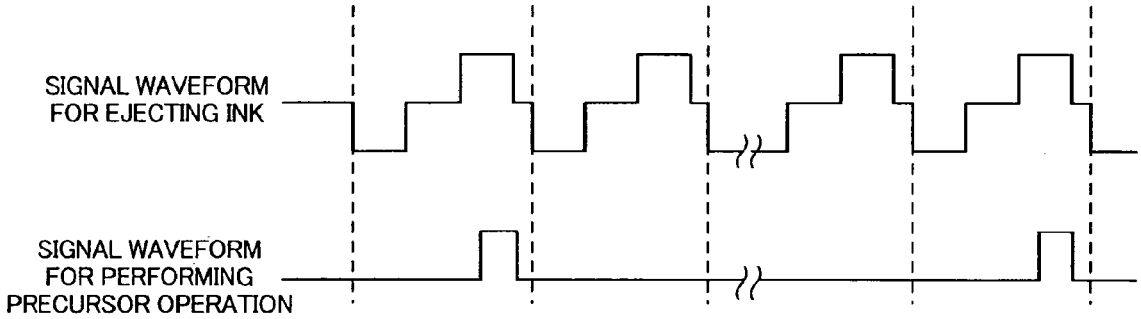
FIG. 4 is a graphic diagram for showing the signal waveform for ejecting ink and the signal waveform for performing precursor operation in accordance with the embodiment of the present invention.

FIG. 4 is a graphic diagram for showing the signal waveform for ejecting ink and the signal waveform for performing the precursor operation. As shown in the same figure, the signal waveform for ejecting ink includes a negative voltage pulse and a positive voltage pulse as a pair to the piezoelectric element. The negative voltage pulse serves to expand the ink chamber, and the positive voltage pulse serves to contract the ink chamber. The signal waveform is repeatedly applied for the number of times corresponding to the number of the droplets to be ejected. In contrast to this, the precursor signal waveform is applied to the piezoelectric elements to the extent that ink is not ejected for the purpose of agitating ink rather than ejecting ink. Because of this, the precursor signal waveform is a waveform to apply only one of a positive voltage pulse and a negative voltage pulse.

Figure 5:
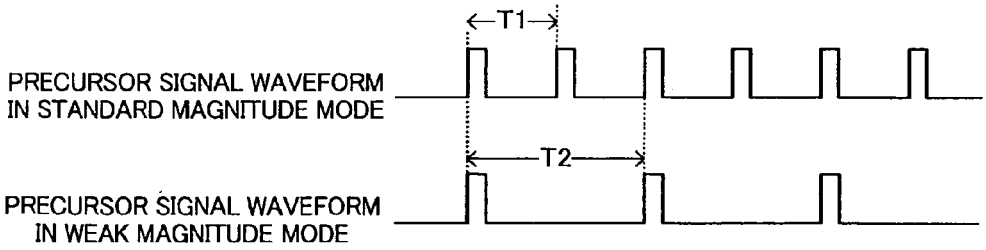
FIG. 5 is a graphic diagram for showing the signal waveform for performing precursor operation in a standard magnitude mode and the signal waveform for performing precursor operation in a weak magnitude mode in accordance with the embodiment of the present invention.

In the case of the present embodiment, it is assumed that there are two magnitude modes, i.e., a standard magnitude mode and a weak magnitude mode when the precursor operation is performed with the precursor signal waveform. Specifically, the magnitude of the precursor operation is controlled by changing the period of pulse (frequency). If the period of the precursor signal waveform in the standard magnitude mode is T1 and the period of the precursor signal waveform in the weak magnitude mode is T2, they satisfy the relation that T1<T2 as illustrated in FIG. 5. Namely, the frequency of the precursor signal in the standard magnitude mode is higher than that of the weak magnitude. For example, the frequency of the precursor signal in the standard magnitude mode may be double that in the weak magnitude mode. When the precursor signal pulses are applied in the weak magnitude mode, the period of the fine vibration becomes longer in the ink chamber such that the ink agitation effect becomes weaker than in the standard magnitude mode.

The reason for preparing the standard magnitude mode and the weak magnitude mode is that there is an ink with which the printing quality is adversely affected when the precursor operation is performed in the standard magnitude mode. That is, a different color ink has a different composition, different characteristics and so forth, so that a certain type of ink, for example, a certain color of ink has a nature that is vulnerable to fine vibration caused by the precursor operation in regard to the printing quality. In what follows, such an ink having a nature that is vulnerable to fine vibration caused by the precursor operation is referred to as the particular ink, and the other inks are referred to as ordinary inks. Of the four color inks which are used, 0~4 color ink(s) may be the particular ink(s).

The printing quality may be adversely affected by the precursor operation, when the precursor operation is performed for the particular ink in the standard magnitude mode which is effective to agitate the ordinary ink. Taking this problem into consideration, in the case of the present embodiment, there is prepared the weak magnitude mode for the particular ink in which the printing quality is little affected by the precursor operation.

Figure 6:
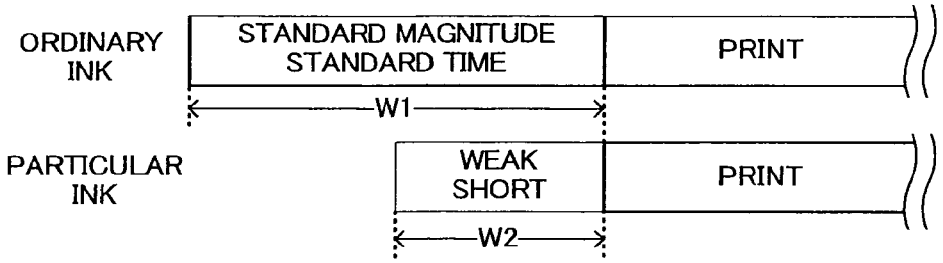
FIG. 6 is a schematic diagram for showing the precursor times for an ordinary ink and a particular ink in accordance with the embodiment of the present invention.

In order to further prevent the printing quality of the particular ink from being adversely affected by the precursor operation, the time of the precursor operation is shortened as illustrated in FIG. 6. Namely, while the precursor pulses are applied to the ordinary ink in the standard magnitude mode for a standard time (W1) in advance of starting the print process for the purpose of sufficiently agitating the ink, the precursor pulses are applied to the particular ink in the weak magnitude mode for a shortened time (W2) in advance of starting the print process for the purpose of avoiding adverse effects on the printing quality due to the precursor operation.

However, as a result of this scheme, the precursor operation becomes less effective to the particular ink, and thereby the ink agitation may not be sufficient for recovering thickened ink. In the case of the present embodiment, therefore, the ink agitation process is controlled in combination with the ink circulation as described in the following examples.

FIRST EXAMPLE

Figure 7:
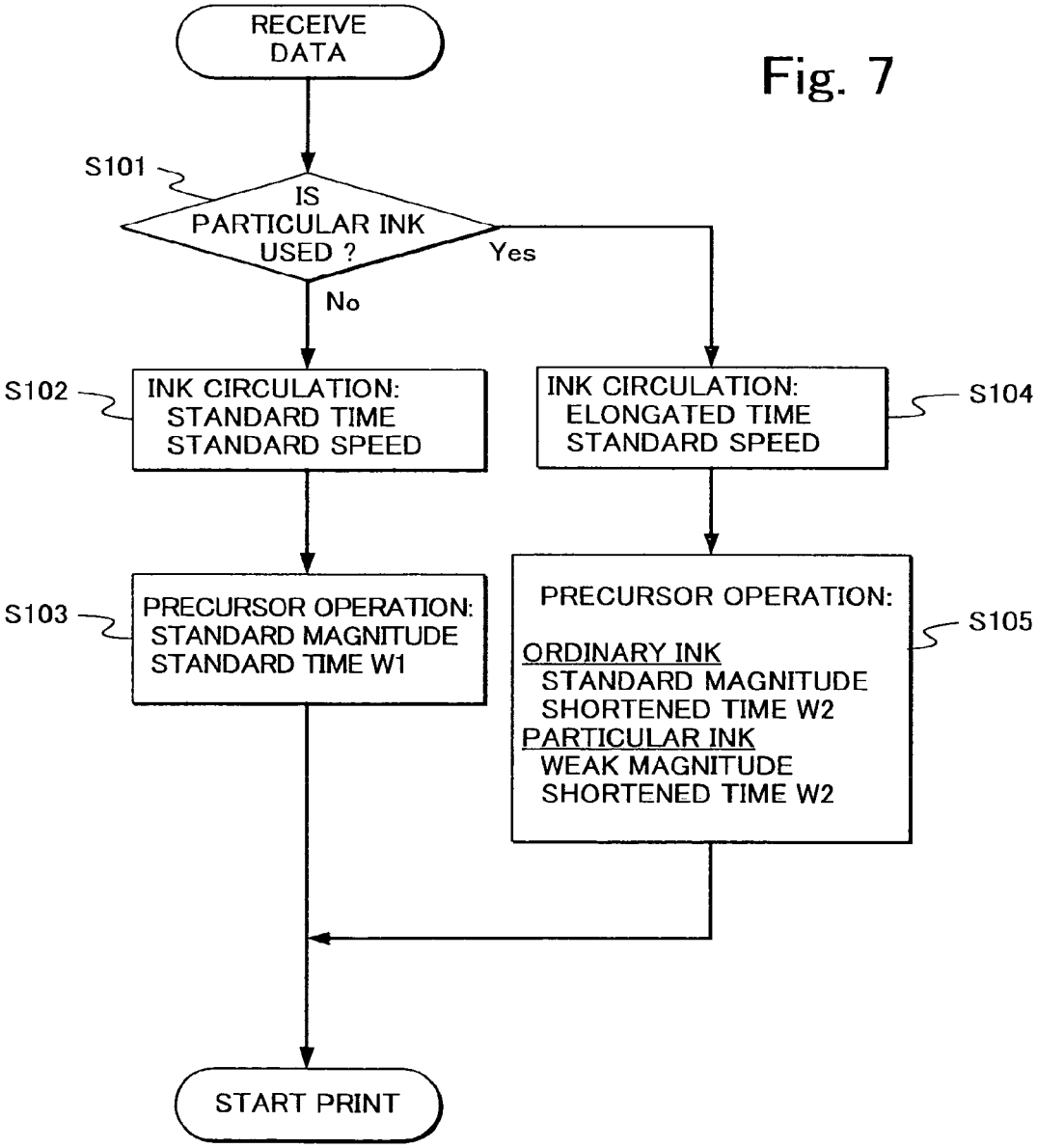
FIG. 7 is a flow chart for explaining the ink agitation process in accordance with a first example of the embodiment of the present invention.

FIG. 7 is a flow chart for explaining the ink agitation process in accordance with the first example. This flow chart shows the control steps after receiving print data until starting printing. In this case, after receiving print data, it is determined whether or not the particular ink is included in the inks used in the ink jet printer 100 in step S101. Incidentally, it is assumed here that the precursor control unit 250 of the control unit 200 stores discrimination information for discriminating between the ordinary inks and the particular inks which are designated in advance. This discrimination information can be updated by rewriting firmware and so forth when necessary.

As a result, when the inks used in the ink jet printer 100 does not include the particular ink (i.e., the "No" branch from step S101), ink circulation is started at a standard speed in step S102. The ink circulation is performed for a predetermined standard time in advance of starting the precursor operation, for the purpose of achieving the effects of ink circulation. Ink is circulated also through the ink chamber of the ink jet head 130 by the ink circulation, and thereby high viscosity ink can be swept away to the ink circulation route to a certain extent. Accordingly, it is possible effectively to avoid ink ejection failure due to high viscosity ink in the ink chamber of the ink jet head 130 by performing the ink circulation and the precursor operation in advance of the print process.

In this case, the ink circulation speed (the ink amount circulated in a unit time) can be controlled by adjusting the suction force of the pump 170. In the case of the present embodiment, it is assumed that the ink circulation speeds for the respective color inks are equally controlled by uniformly adjusting the suction force of the pumps 170 with a simplified control mechanism. However, it is possible to individually control the ink circulation speeds for the respective color inks by separately adjusting the suction forces of the pumps 170C, 170M, 170Y and 170K when the increase in costs is permitted.

Also, the longer the ink circulation time before starting the print process, the more effective the ink circulation in regard to the recovery of thickened ink. However, the start of the print process is delayed by the longer ink circulation time. Then, the ink circulation speed and time in step S102 before starting the print process are determined by taking into consideration the usability of the system and the expected effects of the ink circulation of the ordinary ink. The appropriate ink circulation speed and time are referred to as the standard speed and the standard time respectively which are determined in advance.

Then, when a standard time (C1) elapses after starting the ink circulation, the precursor operation is performed in the standard magnitude mode for the standard time (W1) in step S103. It is possible to perform agitation of the ordinary ink effectively by performing the precursor operation in the standard magnitude mode for the standard time (W1). The print process is then started after performing the precursor operation for the standard time (W1). Incidentally, the ink circulation is continued during the precursor operation and during the subsequent print process.

Figure 8:
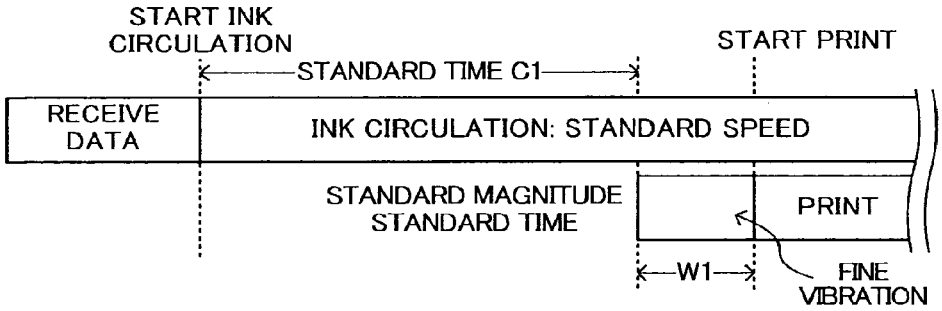
FIG. 8 is a schematic diagram for showing the process in a time series when the particular ink is not used in accordance with the first example.

FIG. 8 is a schematic diagram for showing the process in a time series when the particular ink is not used. As shown in the same figure, after receiving print data, the ink circulation is started at the standard speed. The precursor operation (fine vibration application) is started in the standard magnitude mode when the standard time (C1) elapses after starting the ink circulation. The print process is started after performing the precursor operation in the standard magnitude mode for the standard time (W1). The fine vibration application is the operation for agitating ink.

Returning to FIG. 7, when the inks used in the ink jet printer 100 includes the particular ink (i.e., the "Yes" branch from step S101), ink circulation is started at the standard speed in step S102. However, the ink circulation is continued for an elongated time (C2) which is longer than the standard time (C1) instep S104. More specifically speaking, the subsequent precursor operation for the particular ink is to be performed in the weak magnitude mode for the shortened time (W2) which is not sufficient to achieve necessary ink agitation effects. The ink circulation time (C2) before starting the print process is thereby determined to be longer than the standard time (C1) for the purpose of recovering the thickened particular ink.

However, since the ink circulation time (C2) is longer than the standard time (C1), the ordinary ink is agitated beyond necessity. The precursor operation for the ordinary ink is thereby performed in the standard magnitude mode for a time which is shorter than the standard time (W1) in step S105. While this shorter time can be arbitrarily determined, the shortened time (W2) for the particular ink is used also as this shorter time for the sake of clarity. By this configuration, while recovering the thickened particular ink, it is possible to prevent the ordinary ink from being excessively agitated.

Figure 9:
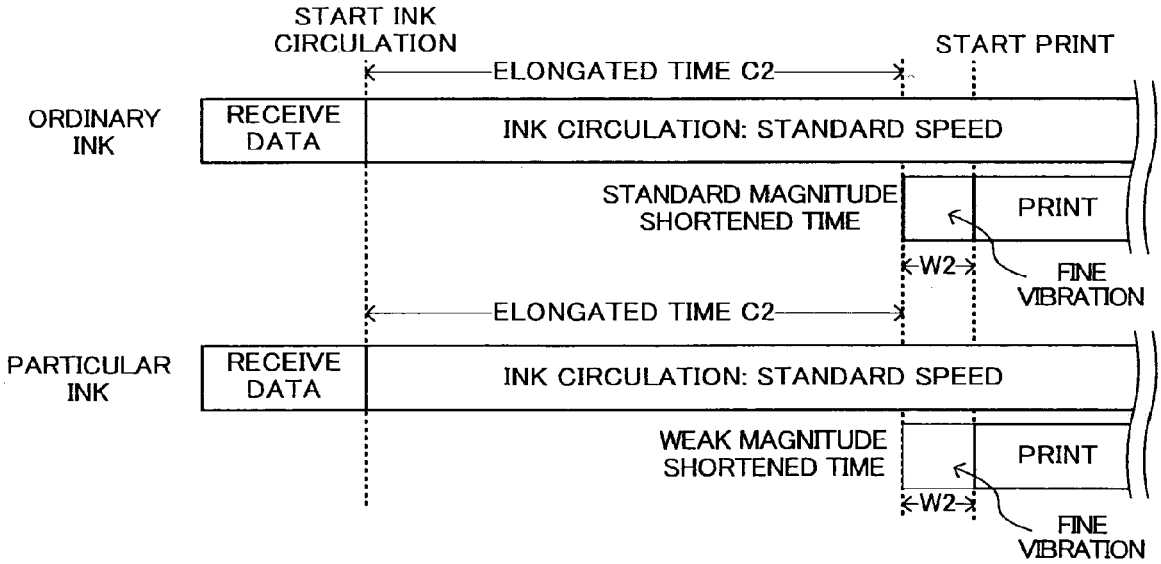
FIG. 9 is a schematic diagram for showing the process in a time series when the particular ink is used in accordance with the first example.

FIG. 9 is a schematic diagram for showing the process in a time series when the particular ink is used in accordance with the first example. As shown in the same figure, after receiving print data, the ink circulation is started at the standard speed for both the ordinary ink and the particular ink. The precursor operation (fine vibration application) is then started when the elongated time (C2) elapses after the ink circulation is started. In this case, however, the precursor operation is performed in the standard magnitude mode for the ordinary ink and in the weak magnitude mode for the particular ink. After performing the precursor operation for the shortened time (W2), the print process is started.

SECOND EXAMPLE

FIG. 10 is a flow chart for explaining the ink agitation process in accordance with the second example. In this case, after receiving print data, ink circulation is started at a standard speed in step S201. The precursor operation is started the standard time after the ink circulation is started. Namely, in the case of the first example, the precursor operation is started when the elongated time elapses after the ink circulation is started so that the start of the print process is delayed. Because of this, in the case of the second example, the precursor operation is started when the standard time elapses after the ink circulation is started so that the print process can be started at an earlier time.

After starting the ink circulation, it is determined whether or not the particular ink is included in the inks used in the ink jet printer 100 in step S202. As a result, when the inks used in the ink jet printer 100 does not include the particular ink (i.e., the "No" branch from step S201), the precursor operation is performed in the standard magnitude mode for the standard time (W1) when the standard time (C1) elapses after the ink circulation is started in step S203 in the same manner as in the first example. It is possible to perform agitation of the ordinary ink effectively by performing the precursor operation in the standard magnitude mode for the standard time (W1). The print process is then started after performing the precursor operation for the standard time (W1).

When the inks used in the ink jet printer 100 includes the particular ink (i.e., the "Yes" branch from step S202), the precursor operation is performed for the ordinary ink for the standard time (W1) in the standard magnitude mode when the standard time (C1) elapses after the ink circulation is started. It is possible to perform agitation of the ordinary ink effectively by performing the precursor operation in the standard magnitude mode for the standard time (W1).

On the other hand, for the particular ink, the precursor operation is performed in the weak magnitude mode for the shortened time (W2). However, the ink agitation effects are not sufficient by performing the precursor operation only once in the weak magnitude mode for the shortened time (W2), so that in the case of the second example the precursor operation is repeatedly performed in step S204 with a break period before each repetition. Ink can be sufficiently agitated by repeating the precursor operation for the shortened time, and thereby thickened ink can be recovered. Also, since the break period is inserted before each repetition of the precursor operation, it is possible to prevent the precursor operation from adversely affecting the printing quality with the particular ink.

FIG. 11 is a schematic diagram for showing the process in a time series when the particular ink is used in accordance with the second example. As shown in the same figure, after receiving print data, the ink circulation is started at the standard speed. The precursor operation (fine vibration application) is then started in the standard magnitude mode for the ordinary ink when the standard time (C1) elapses after the ink circulation. The print process is started after the precursor operation is performed for the standard time (W1). On the other hand, while performing the precursor operation in the standard magnitude mode, the precursor operation is performed in the shortened time for the particular ink in the weak magnitude mode, and repeated for several times with a break period before each repetition. In this case as illustrated, the precursor operation in the weak magnitude mode is repeated for four times.

THIRD EXAMPLE

FIG. 12 is a flow chart for explaining the ink agitation process in accordance with the third example. In this case, after receiving print data, it is determined whether or not the particular ink is included in the inks used in the ink jet printer 100 in step S301. As a result, when the inks used in the ink jet printer 100 does not include the particular ink (i.e., the "No" branch from step S301), ink circulation is started at a standard speed in step S302 in the same manner as the first example. Then, when a standard time (C1) elapses after starting the ink circulation, the precursor operation is performed in the standard magnitude mode for the standard time (W1) in step S303. It is possible to perform agitation of the ordinary ink effectively by performing the precursor operation in the standard magnitude mode for the standard time (W1). The print process is then started after performing the precursor operation for the standard time (W1).

When the inks used in the ink jet printer 100 includes the particular ink (i.e., the "Yes" branch from step S301), ink circulation is started for the standard time. In this case, the ink circulation is performed at a speed which is higher than the standard speed in step S304. Namely, the subsequent precursor operation for the particular ink is to be performed in the weak magnitude mode for the shortened time (W2) which is not sufficient to achieve necessary ink agitation effects. The ink circulation speed before starting the print process is thereby determined to be higher than the standard speed for the purpose of recovering the thickened particular ink.

However, since the ink circulation speed is higher than the standard speed, the ordinary ink is agitated beyond necessity. The precursor operation for the ordinary ink is thereby performed in the standard magnitude mode for a time which is shorter than the standard time (W1) in step S305. While this shorter time can be arbitrarily determined, the shortened time (W2) for the particular ink is used also as this shorter time for the sake of clarity. By this configuration, while recovering the thickened particular ink, it is possible to prevent the ordinary ink from being excessively agitated.

FIG. 13 is a schematic diagram for showing the process in a time series when the particular ink is used in accordance with the third example. As shown in the same figure, after receiving print data, the ink circulation is started at the higher speed. The precursor operation (fine vibration application) is started when the standard time (C1) elapses after starting the ink circulation. In this case, the precursor operation is performed in the standard magnitude mode for the ordinary ink but in the weak magnitude mode for the particular ink. For both the ordinary ink and the particular ink, the precursor operation is continued for the shortened time (W2) followed by starting the print process.

MODIFICATION EXAMPLE

Figure 14:
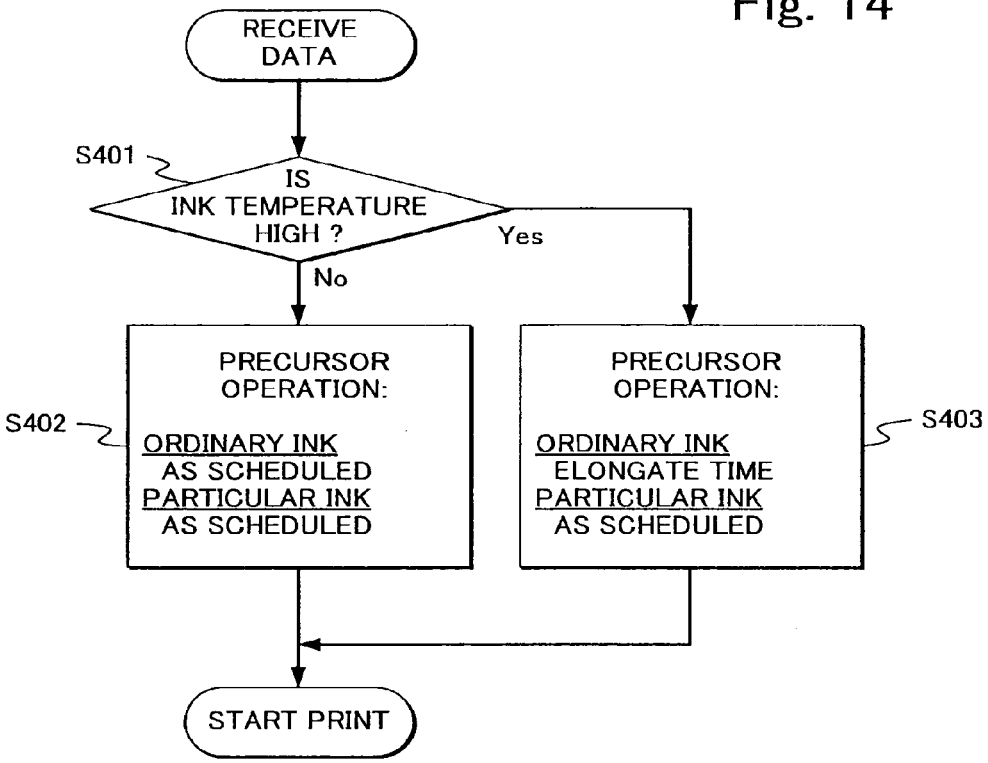
FIG. 14 is a flow chart for explaining the ink agitation process for the ordinary ink in accordance with a modification example of the present invention.

Next, a modification example will be explained. Generally speaking, the viscosity of ink tends to increase when the temperature rises. Therefore, for the first and second examples as have been discussed above, it is considered effective to further control the precursor operation on the basis of the ink temperature as illustrated in the flow chart of FIG. 14.

That is, after receiving print data, it is determined whether or not the ink temperature is high by detecting the ink temperature with the thermometer 134 in step S401. For example, if the ink temperature exceeds 35 degrees, it is determined that the ink temperature is high.

When the ink temperature is not high (i.e., the "No" branch from step S401), i.e., at a normal temperature, the precursor operation is performed for both the ordinary ink and the particular ink in the same manner as described in the first example through the third example.

On the other hand, when the ink temperature is high (i.e., the "Yes" branch from step S401), a time which is longer than the time set up in the first example through the third example is set up as precursor time. By this configuration, the ink agitation time is elongated, it is possible to recover the ordinary ink whose viscosity is increased at a high temperature. On the other hand, if the precursor times for the particular ink are elongated to be longer than those described in the first example through the third example, the printing quality may be adversely affected by the precursor operation. The precursor times for the particular ink are not elongated even at a high temperature.

Figure 15:
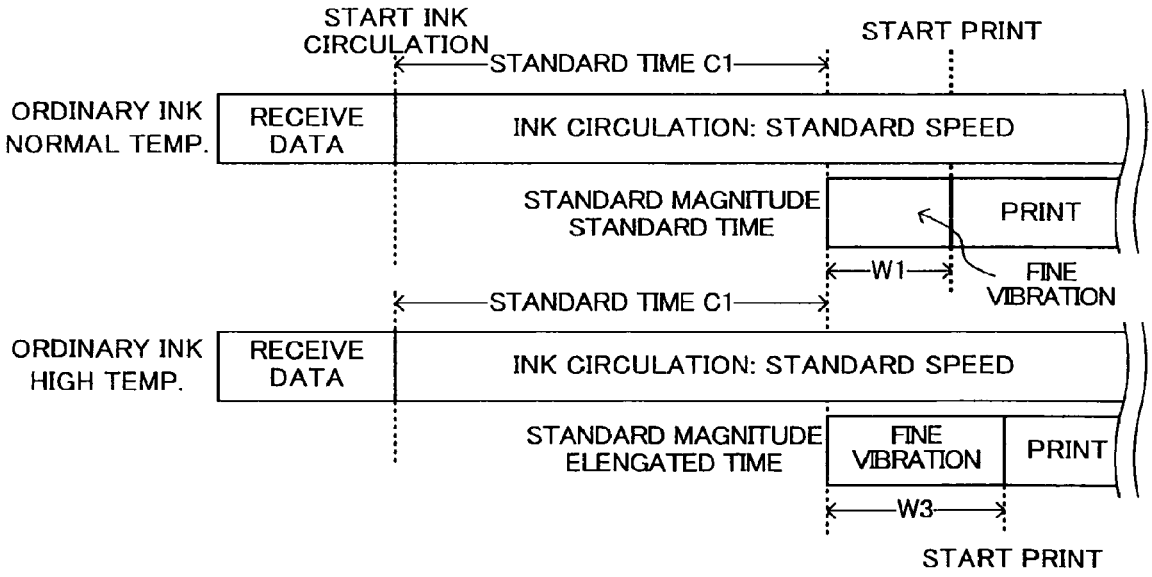
FIG. 15 is a schematic diagram for showing the process of handling the ordinary ink in a time series in accordance with the modification example.

FIG. 15 is a schematic diagram for showing the process of handling the ordinary ink in a time series in accordance with the modification example. As shown in the same figure, after receiving print data, the ink circulation is started at a high temperature and at a normal temperature. It is assumed here that the standard speed is set up. The precursor operation (fine vibration application) is started when the standard time (C1) elapses after starting the ink circulation. It is assumed here that the standard time (W1) and the standard magnitude mode are set up.

In this case, the print process is started after performing the precursor operation for the standard time (W1) at a normal temperature. However, at a high temperature, the print process is started after performing the precursor operation for an elongated time (W3) which is longer than the standard time (W1). By this configuration, it is possible to recover the ordinary ink whose viscosity is increased at a high temperature.

The embodiment of the present invention has been explained with the respective examples. However, there is supplemental information as follows. Namely, the control scheme is based on the assumption that the precursor operation for the ordinary ink is performed in the standard magnitude mode which is appropriately determined for processing the ordinary ink. This appropriate standard magnitude may slightly vary depending upon the ordinary ink.

On the other hand, the control scheme is based on the assumption that the precursor operation for the particular ink is performed in the weak magnitude mode which is appropriately determined for processing the particular ink. This appropriate weak magnitude may slightly vary depending upon the particular ink.

The reason for processing the ordinary ink by performing the precursor operation for the standard time (W1) in the standard magnitude mode is as follows. Namely, while the precursor operation is effective in the weak magnitude mode when performing for a longer time, this operation is a preprocess to be performed in advance of actually performing the print process so that a shorter time is basically preferred. In addition, this is because if the precursor operation is performed with an excessively weaker magnitude (low frequency), little effect can be achieved even when the precursor operation is continued for a longer time.

The standard time (W1), the shortened time (W2) and the elongated time (W3) used in the above examples can be experimentally determined in order that the printing quality reaches a certain acceptable level when the ordinary ink and the particular ink are used for printing as described above. As long as the printing quality is acceptable, the standard time (W1) and the shortened time (W2) may be common to or different among the examples (for example, between the examples of FIG. 9 and FIG. 13). In other words, as long as the printing quality experimentally falls in an acceptable range, each of the standard magnitude, the weak magnitude, the standard time (W1), the shortened time (W2) and the elongated time (W3) may not be fixed to one value but can be given as a certain range.

What is claimed is:

1. An ink jet printer which performs a print process by ejecting ink for each of a plurality of ink colors, the ink jet printer comprising:

a plurality of ink jet heads provided for the plurality of ink colors respectively, each ink jet head being provided with an ink ejection unit set;

a plurality of ink circulation routes provided for the plurality of ink colors respectively, each ink circulation route including the ink jet head corresponding thereto;

an ink agitating operation drive signal generation unit operable to generate an ink agitating operation drive signal to be applied to the ink ejecting unit sets of the ink jet heads, to make ink agitating operation to the extent that ink is not ejected, in advance of starting the print process; and an ink circulation control unit operable to control ink circulation in the ink circulation routes, wherein the ink circulation control unit starts ink circulation in advance of starting the print process, wherein, after starting the ink circulation, the ink agitating operation drive signal generation unit applies the ink agitating operation drive signal, having a first predetermined first period, to the ink ejecting unit set operable to eject an ink, which has a predetermined nature, for a predetermined first ink agitating operation time, and repeating this application of the ink agitating operation drive signal with a break period before each repetition, wherein, when a predetermined second circulation time elapses from a start of ink circulation, the ink agitating operation drive signal generation unit applies the ink agitating operation drive signal, having a predetermined second period shorter than the first period, to the ink ejecting unit set operable to eject an ink, which does not have the predetermined nature, for a predetermined third ink agitating operation time which is longer than the first ink agitating operation time.

2. The ink jet printer as claimed in claim 1 wherein in the case where the ink jet printer does not use the ink ejecting unit set operable to eject the ink which has the predetermined nature, when the second circulation time elapses after starting the ink circulation, the ink agitating operation drive signal generation unit applies the ink agitating operation drive signal to the ink ejecting unit set in the second period for the third ink agitating operation time.

* * * * *